US005669234A

United States Patent [19]

Houser et al.

[11] Patent Number: 5,669,234

[45] Date of Patent: Sep. 23, 1997

[54] EFFICIENCY IMPROVEMENT OF OPEN-CYCLE CASCADED REFRIGERATION PROCESS

[75] Inventors: Clarence G. Houser, Houston; Jame Yao, Sugar Land, both of Tex.; Donald L. Andress; William R. Low, both of Bartlesville, Okla.

[73] Assignee: Phillips Petroleum Company, Bartlesville, Okla.

[21] Appl. No.: 683,282

[22] Filed: Jul. 16, 1996

[51] Int. Cl.[6] ..... F25J 1/00

[52] U.S. Cl. ..... 62/612; 62/619

[58] Field of Search ..... 62/612, 619

[56] References Cited

U.S. PATENT DOCUMENTS

| | | | |
|---|---|---|---|
| 3,413,816 | 12/1968 | De Marco | 62/21 |
| 4,172,711 | 10/1979 | Bailey | 62/28 |
| 4,229,195 | 10/1980 | Forg | 62/612 |
| 4,256,476 | 3/1981 | Van Baush | 62/612 |
| 4,430,103 | 2/1984 | Gray et al. | 62/28 |
| 4,680,041 | 7/1987 | Delong | 62/612 |
| 4,698,080 | 10/1987 | Gray et al. | 62/21 |

OTHER PUBLICATIONS

Kniel. L. (1973). *Chemical Engineering Progress* (vol. 69, No. 10) entitled "Energy Systems for LNG Plants".

Harper, E. A., Rust, J. R. and Lean, L. E. (1975). *Chemical Engineering Progress* (vol. 71, No. 11) entitled "Trouble Free LNG".

Haggin, J. (1992). *Chemical and Engineering News* (Aug. 17, 1992) entitled "Large Scale Technology Characterizes Global LNG Activities" provides background information concerning the relative scale of projects for natural gas liquefaction.

Collins, C., Durr, C. A., de la Vega, F. F. and Hill, D. K. (1995). *Hydrocarbon Processing* (Apr. 1995) entitled "Liquefaction Plant Design in the 1990s" generally discloses basic background information concerning recent developments in the production of LNG.

*Primary Examiner*—Ronald C. Capossela
*Attorney, Agent, or Firm*—Gary L. Haag

[57] ABSTRACT

A process and apparatus for improving the efficiency of an open-cycle cascaded refrigeration process. Process efficiency is improved by the manner in which the compressed recycle stream is combined with the main process stream in the open refrigeration cycle.

29 Claims, 3 Drawing Sheets

EFFICIENCY IMPROVEMENT OF OPEN-CYCLE CASCADED REFRIGERATION PROCESS

This invention concerns a method and an apparatus for improving the efficiency of an open-cycle cascaded refrigeration process.

BACKGROUND

Cryogenic liquefaction &normally gaseous materials is utilized for the purpose of component separation, purification, storage and for the transportation of said components in a more economic and convenient form. Most such liquefaction systems have many operations in common, regardless of the gases involved, and consequently, have many of the same problems. One common problem in such liquefaction processes is the existence of thermodynamic irreversibilities in the various cooling cycles which reduce process efficiency to values significantly lower than theoretically possible. Accordingly, the present invention will be described with specific reference to the processing of natural gas but is applicable to other gas systems wherein an open refrigeration cycle is employed and a liquefied product is produced from such cycle.

It is common practice in the art of processing natural gas to subject the gas to cryogenic treatment to separate hydrocarbons having a molecular weight higher than methane ($C_2$+) from the natural gas thereby producing a pipeline gas predominating in methane and a $C_2$+ stream useful for other purposes. Frequently, the $C_2$+ stream will be separated into individual component streams, for example, $C_2$, $C_3$, $C_4$ and $C_5$+.

It is also common practice to cryogenically treat natural gas to liquefy the same for transport and storage. The primary reason for the liquefaction of natural gas is that liquefaction results in a volume reduction of about 1/600, thereby making it possible to store and transport the liquefied gas in containers of more economical and practical design. For example, when gas is transported by pipeline from the source of supply to a distant market, it is desirable to operate the pipeline under a substantially constant and high load factor. Often the deliverability or capacity of the pipeline will exceed demand while at other times the demand may exceed the deliverability of the pipeline. In order to shave off the peaks where demand exceeds supply, it is desirable to store the excess gas in such a manner that it can be delivered when the supply exceeds demand, thereby enabling future peaks in demand to be met with material from storage. One practical means for doing this is to convert the gas to a liquefied state for storage and to then vaporize the liquid as demand requires.

Liquefaction of natural gas is of even greater importance in making possible the transport of gas from a supply source to market when the source and market are separated by great distances and a pipeline is not available or is not practical. This is particularly true where transport must be made by ocean-going vessels. Ship transportation in the gaseous state is generally not practical because appreciable pressurization is required to significantly reduce the specific volume of the gas which in turn requires the use of more expensive storage containers.

In order to store and transport natural gas in the liquid state, the natural gas is preferably cooled to −240° F. to −260° F. where it possesses a near atmospheric vapor pressure. Numerous systems exist in the prior art for the liquefaction of natural gas or the like in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, and methane. In the art, the refrigerants are frequently arranged in a cascaded manner and each refrigerant is employed in a closed refrigeration cycle.

When the condensed liquid is at an elevated pressure, further cooling is possible by expanding the liquefied natural gas to atmospheric pressure in one or more expansion stages. In each stage, the liquefied gas is flashed to a lower pressure thereby producing a two-phase gas-liquid mixture at a significantly lower temperature. The liquid is recovered and may again be flashed. In this manner, the liquefied gas is further cooled to a storage or transport temperature suitable for liquefied gas storage at near-atmospheric pressure. In this expansion to near-atmospheric pressure, significant volumes of liquefied gas are flashed. The flash vapors from the expansion stages are generally collected and recycled for liquefaction or utilized as fuel gas for power generation.

In what is referred to as an open cycle, the final refrigeration cycle consists of flashing the liquefied product in distinct steps, using the flash vapors for cooling, recompressing a majority of the flash vapors, cooling said compressed gas stream and returning the compressed cooled gas stream to the liquefaction process for liquefaction. In the associated heat exchange processes, thermodynamic irreversibilities can be reduced by reducing the temperature gradients between the fluids undergoing heat exchange. This generally requires countercurrent flow of fluids through the heat exchangers, significant quantities of heat transfer area, and the selection of flowrates and temperatures for the streams undergoing heat exchange which provide for efficient heat transfer. From a cost perspective, costs associated with the loss of thermodynamics efficiency are frequently balanced against the additional cost of capital for additional heat transfer area, piping and other items which improve thermodynamic efficiencies. The search for novel and cost-effective means for improving the thermodynamic efficiency of an open cycle cascaded refrigeration process has been an area of interest for many years.

SUMMARY OF THE INVENTION

It is an object of this invention to increase process efficiency in an open-cycle cascaded refrigeration process.

It is a further object of this invention to increase process efficiency in an open-cycle cascaded refrigeration process by increasing the efficiency of the closed refrigeration cycle immediately upstream of the open refrigeration cycle.

It is a still further object of the present invention that the refrigeration duty of the closed cycle immediately upstream of the open cycle in an open-cycle cascaded refrigeration process be modified by increasing the relative duty in said cycle to the high stage chiller and reducing the cooling duty to the low stage condenser.

It is still yet a further object of this invention that the method and associated apparatus for increasing process efficiency be simple, compact and cost-effective.

It is yet a further object of this invention that the method and apparatus for increasing process efficiency employ readily available components and require minimal modifications to prior art refrigerative cooling methodologies and commercially employed apparatus.

In one embodiment of this invention, an improved open-cycle cascaded refrigeration process for liquefying in major portion a pressurized gas stream has been discovered comprising the steps of:

(a) cooling a compressed open-cycle gas stream via countercurrent or generally countercurrent heat transfer with one or more open-cycle flash vapor streams to a first temperature;

(b) splitting said cooled compressed open-cycle gas stream into a first cooled recycle stream and a second stream;

(c) combining said first cooled recycle stream with the pressurized gas stream immediately upstream of the first stage of cooling in the closed refrigeration cycle;

(d) cooling the gas stream of step (c) by flow through at least one stage of refrigerative cooling;

(e) further cooling said second stream via countercurrent or generally countercurrent heat transfer with one or more open-cycle flash vapor streams to a second temperature thereby producing a second cooled recycle stream;

(f) combining said second cooled recycle stream with the gas stream of step (d) but upstream of the stage of refrigerative cooling wherein said stream is liquefied in major portion.

In another embodiment of this invention, an apparatus for efficiently cooling the compressed open cycle stream prior to combination with the pressurized feed gas stream in an open-cycle cascaded refrigeration process has been discovered comprising:

(a) an indirect heat exchange means in flow communication with the outlet port of the open-cycle compressor;

(b) at least one indirect heat exchange transfer means connected to a conduit returning an open-cycle flash gas stream wherein said means is in close proximity to element (a) so as to provide for heat exchange between the two means and said means are arranged to provide for countercurrent or generally countercurrent flow of the respective fluids delivered to the conduits;

(c) a conduit connected at a location alongside the indirect heat exchange means of (a) and wherein said conduit is in flow communication with the conduit delivering the pressurized gas stream to the first stage of cooling in a closed refrigeration cycle or said conduit is in direct flow communication with said first stage of cooling to which the pressurized gas stream is also delivered; and (d) a conduit connected to the exit end of said indirect heat exchange means of (a) wherein said conduit is connected to a conduit bearing the pressurized gas stream at some location downstream of the first stage of cooling.

BREIF DESCRIPTION OF THE DRAWINGS

DESCRIPTION OF THE PREFERRED EMBODIMENT

Figure 1:
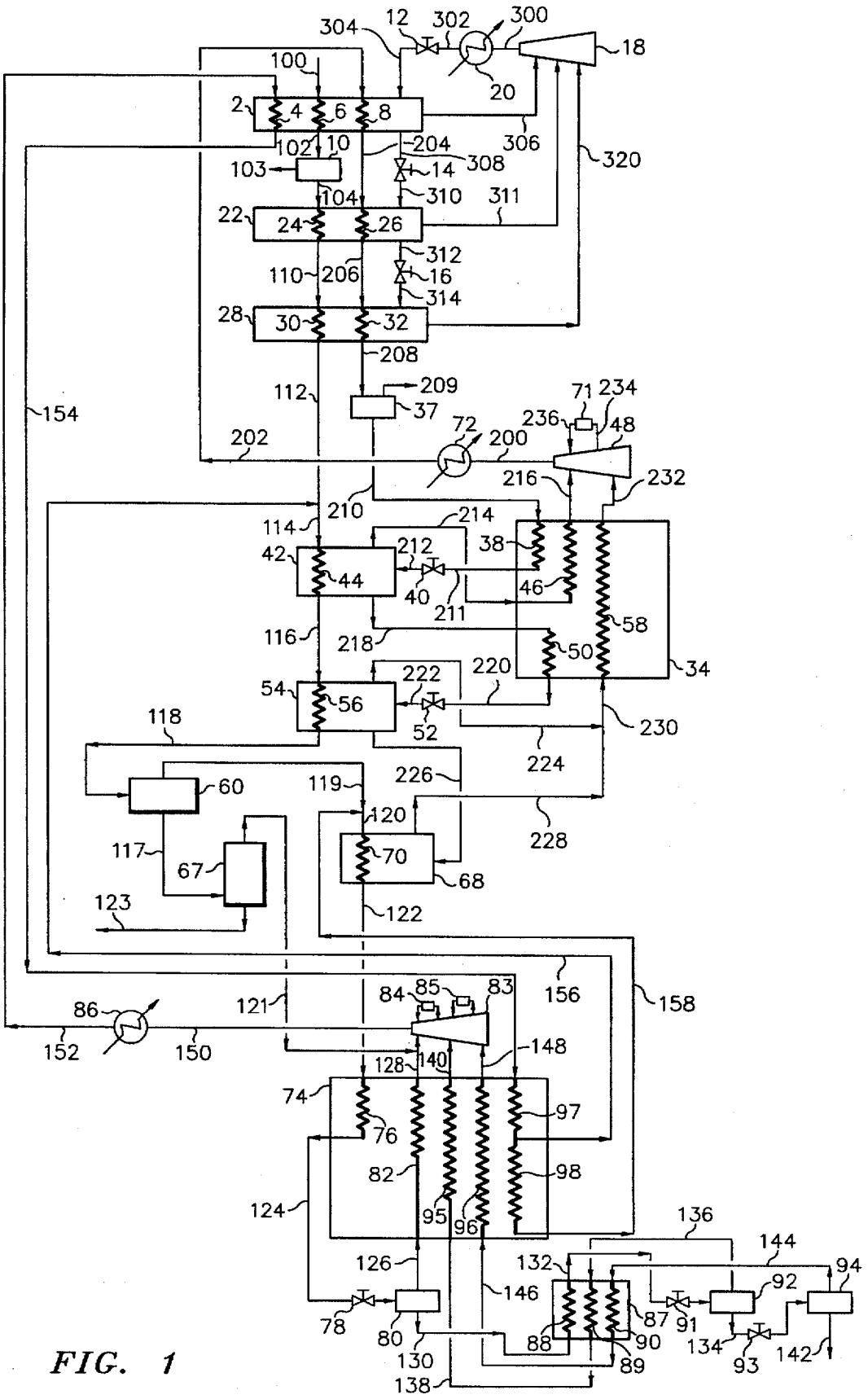
FIG. 1 is a simplified flow diagram of a cryogenic LNG production process which illustrates the methodology and apparatus of the present invention.

While the present invention is applicable for improving process efficiencies in cascaded refrigeration processes which employ a final open cycle where such processes are employed for the cryogenic processing of gas, the following description for the purposes of simplicity and clarity will make specific reference to the cryogenic cooling of a natural gas stream to produce liquefied natural gas. However, problems associated with less than desired process efficiencies are common to all cryogenic process employing an open cycle.

As used herein, the term open-cycle cascaded refrigeration process refers to a cascaded refrigeration process employing at least one closed refrigeration cycle and one open-cycle wherein the boiling point of the refrigerant/cooling agent in the open cycle is less than the boiling point of the refrigerating agent or agents employed in the closed cycle or cycles and a portion of the cooling duty to condense the compressed open-cycle refrigerant/cooling agent is provided by one or more of the closed cycles.

As noted in the background section hereof, the design of a cascaded refrigeration process involves a balancing of thermodynamic efficiencies and capital costs. In heat transfer processes, thermodynamic irreversibilities are reduced as the temperature gradients between heating and cooling fluids become progressively less, but obtaining small temperature gradients generally requires significant increases in the amount of heat transfer area and major modifications to various process equipment and the proper selection of flowrates through such equipment so as to ensure that flowrates and approach and outlet temperatures are compatible with the required heating/cooling duty. When processing a natural gas stream, the present invention provides a simple, cost-effective means for significantly reducing the temperature gradients between the open-cycle compressed methane-based gas stream (i.e., recycle stream) and the flash vapor streams from LNG flashing thereby resulting in a significant reduction in the power requirements of the closed cycle immediately upstream of the open cycle and furthermore, beneficially shifting the cooling duties in such closed cycle to the preceding or higher temperature stage or stages.

Natural Gas Stream Liquefaction

Cryogenic plants have a variety of forms; the most efficient and effective being an optimized cascade-type operation and this optimized type in combination with expansion-type cooling. Also, since methods for the production of liquefied natural gas (LNG) include the separation of hydrocarbons of higher molecular weight than methane as a first part thereof, a description of a plant for the cryogenic production of LNG effectively describes a similar plant for removing $C_2$+ hydrocarbons from a natural gas stream.

In the preferred embodiment, the invention concerns the sequential cooling of a natural gas stream at an elevated pressure, for example about 650 psia, by sequentially cooling the gas stream by passage through a multistage propane cycle, a multistage ethane or ethylene cycle and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point.

Pretreatment steps provide a means for removing undesirable components such as acid gases, mercaptan, mercury and moisture from the natural gas stream feed stream delivered to the facility. The composition of this gas stream may vary significantly. As used herein, a natural gas stream is any stream principally comprised of methane which originates in major portion from a natural gas feed stream, such feed stream for example containing at least 85% by volume, with the balance being ethane, higher hydrocarbons, nitrogen, carbon dioxide and a minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptan are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves. Processes employing sorbent beds are generally located downstream of the first cooling stage in the initial cooling cycle.

The natural gas is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 650 psia. The stream temperature is typically near ambient to slightly above ambient. A representative temperature range being 60° F. to 120° F.

As previously noted, the natural gas stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally 2, preferably two to four, and more preferably three stages, in the first closed refrigeration cycle utilizing a relatively high boiling refrigerant. Such refrigerant is preferably comprised in major portion of propane, propylene or mixtures thereof, more preferably propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably ethylene, and most preferably the refrigerant consists essentially of ethylene. Each cooling stage comprises a separate cooling zone.

Generally, the natural gas feed will contain such quantities of $C_2$+components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$, and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the latter case, the methane-rich stream can be directly returned at pressure to the liquefaction process. In the former case, the methane-rich stream can be repressurized and recycle or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+). In the last stage of the second cooling cycle, the gas stream which is predominantly methane is condensed (i.e., liquefied) in major portion, preferably in its entirety. The process pressure at this location is only slightly lower than the pressure of the feed gas to the first stage of the first cycle.

The liquefied natural gas stream is then further cooled in a third step or the open cycle via contact in a main methane economizer with flash gases generated in this third step in a manner to be described later and subsequent expansion of the liquefied gas stream to near atmospheric pressure. During this expansion, the liquefied product is cooled via at least one, preferably two to four, and more preferably three expansions where each expansion employs as a pressure reduction means either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash step will frequently more than off-set the more expensive capital and operating costs associated with the expander. In one embodiment, additional cooling of the high pressure liquefied product prior to flashing is made possible by first flashing a portion of this stream via one or more hydraulic expanders and then via indirect heat exchange means employing said flashed stream to cool the high pressure liquefied stream prior to flashing. The flashed product is then recycled via return to an appropriate location, based on temperature and pressure considerations, in the open methane cycle and will finally be recompressed. As used herein, open methane cycle stream will refer to a stream which is predominantly methane and originates in major portion from flash vapors from liquefied product and open methane cycle will refer to an open cycle employing said stream. Liquefied product will generically be referred to as methane although it may contain minor concentrations of other constituents.

When the liquid product entering the third cycle is at a preferred pressure of about 600 psia, representative flash pressures for a three stage flash process are about 190, 61 and 24.7 psia. Vapor flashed or fractioned in the nitrogen separation step to be described and then flashed in the expansion flash steps are utilized in the main methane economizer to cool the just liquefied product from the second cycle/step prior to expansion and to cool the compressed open methane cycle stream. The inventive means and associated apparatus for recycling the flashed product will be discussed in a later section. Flashing of the liquefied stream to near atmospheric pressure produces an LNG product possessing a temperature of −240° F. to −260° F.

To maintain an acceptable BTU content in the liquefied product when appreciable nitrogen exists in the natural gas feed gas, nitrogen must be concentrated and removed at some location in the process. Various techniques are available for this purpose to those skilled in the art. The following are examples. When nitrogen concentration in the feed is low, typically less than about 1.0 vol. %, nitrogen removal is generally achieved by removing a small stream at the high pressure inlet or outlet port at the open methane cycle compressor. When the nitrogen concentration in the inlet feed gas is about 1.0 to about 1.5 vol %, nitrogen can be removed by subjecting the liquefied gas stream from the main methane economizer to a flash prior to the expansion steps previously discussed. The use of this flash step is demonstrated in the Example. The flash vapor will contain an appreciable concentration of nitrogen and may be subsequently employed as a fuel gas. A typical flash pressure for nitrogen removal at these concentrations is about 400 psia. When the feed stream contains a nitrogen concentration of greater than about 1.5 vol %, the flash step following flow through the main methane economizer may not provide sufficient nitrogen removal and a nitrogen rejection column will be required from which is produced a nitrogen rich vapor stream and a liquid stream. In a preferred embodiment employing a nitrogen rejection column, the high pressure liquefied methane stream to the main methane economizer is split into a first and second portion. The first portion is flashed to approximately 400 psia and the two-phase mixture is fed as a feed stream to the nitrogen rejection column. The second portion of the high pressure liquefied methane stream is further cooled by flowing through the main methane economizer, it is then flashed to 400 psia, and the resulting two-phase mixture is fed to the column where it provides reflux. The nitrogen-rich gas stream produced from the top of the nitrogen rejection column will generally be used as fuel. Produced from the bottom of the column is a liquid stream which is either returned to the main methane economizer for cooling or in the preferred embodiment, is fed to the next stage of expansion for the open methane cycle stream.

Refrigerative Cooling for Natural Gas Liquefaction

Critical to the liquefaction of natural gas in a cascaded process is the use of one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures.

The inventive process uses several types of cooling which include but are not limited to (a) indirect heat exchange, (b) vaporization and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, in the inventive process, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

In the discussion and drawings to follow, the discussions or drawings may depict the expansion of a refrigerant by flowing through a throttle valve followed by a subsequent separation of gas and liquid portions in the refrigerant chillers wherein indirect heat-exchange also occurs. While this simplified scheme is workable and sometimes preferred because of cost and simplicity, it may be more effective to carry out expansion and separation and then partial evaporation as separate steps, for example a combination of throttle valves and flash drums prior to indirect heat exchange in the chillers. In another workable embodiment, the throttle or expansion valve may not be a separate item but an integral part of the refrigerant chiller (i.e., the flash occurs upon entry of the liquefied refrigerant into the chiller).

In the first cooling cycle or step, cooling is provided by the compression of a higher boiling point gaseous refrigerant, preferably propane, to a pressure where it can be liquefied by indirect heat transfer with a heat transfer medium which ultimately employs the environment as a heat sink, that heat sink generally being the atmosphere, a fresh water source, a salt water source, the earth or a two or more of the preceding. The condensed refrigerant then undergoes one or more steps of expansion cooling via suitable expansion means thereby producing two-phase mixtures possessing significantly lower temperatures. In one embodiment, the main stream is split into at least two separate streams, preferably two to four streams, and most preferably three streams where each stream is separately expanded to a designated pressure. Each stream then provides vaporative cooling via indirect heat transfer with one or more selected streams, one such stream being the natural gas stream to be liquefied. The number of separate refrigerant streams will correspond to the number of refrigerant compressor stages. The vaporized refrigerant from each respective stream is then returned to the appropriate stage at the refrigerant compressor (e.g., two separate streams will correspond to a two-stage compressor). In a more preferred embodiment, all liquefied refrigerant is expanded to a predesignated pressure and this stream then employed to provide vaporative cooling via indirect heat transfer with one or more selected streams, one such stream being the natural gas stream to be liquefied. A portion of the liquefied refrigerant is then removed from the indirect heat exchange means, expansion cooled by expanding to a lower pressure and correspondingly lower temperature where it provides vaporative cooling via indirect heat exchange means with one or more designated streams, one such stream being the natural gas stream to be liquefied. Nominally, this embodiment will employ two such expansion cooling/vaporative cooling steps, preferably two to four, and most preferably three. Like the first embodiment, the refrigerant vapor from each step is returned to the appropriate inlet port at the staged compressor.

In a cascaded refrigeration system, a significant portion of the cooling for liquefaction of the lower boiling point refrigerants (i.e., the refrigerants employed in the second and third cycles) is made possible by cooling these streams via indirect heat exchange with selected higher boiling refrigerant streams. This manner of cooling is referred to as "cascaded cooling." In effect, the higher boiling refrigerants function as heat sinks for the lower boiling refrigerants or stated differently, heat energy is pumped from the natural gas stream to be liquefied to a lower boiling refrigerant and is then pumped (i.e., transferred) to one or more higher boiling refrigerants prior to transfer to the environment via an environmental heat sink (ex., fresh water, salt water, atmosphere). As in the first cycle, refrigerant employed in the second and third cycles are compressed via compressors, preferably multi-staged compressors, to preselected pressures. When possible and economically feasible, the compressed refrigerant vapor is first cooled via indirect heat exchange with one or more cooling agents (ex., air, salt water, fresh water) directly coupled environmental heat sinks. This cooling may be via inter-stage cooling between compression stages or cooling of the fully compressed refrigerant. The compressed stream is then further cooled via indirect heat exchange with one or more of the previously discussed cooling stages for the higher boiling point refrigerants. As used herein, compressor shall refer to compression equipment associated with all stages of compression and any equipment associated with inter-stage cooling.

The second cycle refrigerant, preferably ethylene, is preferably first cooled after compression via indirect heat exchange with one or more cooling agents directly coupled to an environmental heat sink (i.e., inter-stage and/or post-cooling following compression) and then further cooled and finally liquefied via sequentially contacted with the first and second or first, second and third cooling stages for the highest boiling point refrigerant which is employed in the first cycle. The preferred second and first cycle refrigerants are ethylene and propane, respectively.

In the open-cycle portion of the cascaded refrigeration system such as illustrated in FIG. 1, cooling occurs by (1) subcooling the pressurized LNG liquid product prior to flashing by contacting said liquid with downstream flash vapors and (2) cooling the compressed recycle stream by contacting with said flash vapors. As just noted, the liquefied LNG product from the second cycle is first cooled in the open or third cycle via indirect contact with one or more flash vapor streams from subsequent flash steps followed by the subsequent pressure reduction of the cooled stream. The pressure reduction is conducted in one or more discrete steps. In each step, significant quantities of methane-rich vapor at a given pressure are produced. Each vapor stream preferably undergoes significant heat transfer in the methane economizers via contact with a liquefied stream about to be flashed or the pressurized recycle stream and is preferably returned to the inlet port of a compressor stage at near-ambient temperatures. In the course of flowing through the methane economizers, the flash vapors are contacted with warmer streams in a generally countercurrent manner, preferably a countercurrent manner, and in a sequence designed to maximize the cooling of the warmer streams. The pressure selected for each stage of expansion cooling is such that for each stage, the volume of gas generated plus the compressed volume of vapor from the adjacent lower stage results in efficient overall operation of the multi-staged compressor.

The warmed flash or recycle streams, excluding any nitrogen rejection stream, are returned, preferably at near-ambient temperature, to the inlet ports of the compressor whereupon these streams are compressed to a pressure such that they can be combined with the main process stream prior to liquefaction. Interstage cooling and cooling of the compressed methane gas stream (i.e., compressed recycle stream) is preferred and preferably accomplished via indirect heat exchange with one or more cooling agents directly coupled to an environment heat sink. The compressed methane gas stream is then further cooled via indirect heat exchange with refrigerant in the first and second cycles, preferably the first cycle refrigerant in all stages, more preferably the first two stages and most preferably, the first stage. The cooled methane stream is further cooled via indirect heat exchange with flash vapors in the main methane economizer and is then combined with the natural gas feed stream in the inventive manner to be described. In the prior art, the recombination occurred immediately prior to the final stage of cooling in the second cycle wherein the combined stream was liquefied.

Optimization via Inter-stage and Inter-cycle Heat Transfer

Returning the refrigerant gas streams to their respective compressors at or near ambient temperature is generally favored. Not only does this step improve overall efficiencies, but difficulties associated with the exposure of compressor components to cryogenic conditions are greatly reduced. This is accomplished via the use of economizers wherein streams comprised in major portion of liquid and prior to flashing are first cooled by indirect heat exchange with one or more vapor streams generated in a downstream expansion step (i.e., stage) or steps in the same or a downstream cycle. As an example, flash vapors in the open or third cycle preferably flow through one or more economizers where (1) these vapors cool via indirect heat exchange the liquefied product streams prior to each pressure reduction stage and (2) these vapors cool via indirect heat exchange the compressed open methane cycle gas stream prior to recycling and combination with the natural gas stream. These cooling steps will be discussed in greater detail in the discussion of FIG. 1. In one embodiment wherein ethylene and methane are employed in the second and open or third cycles respectively, the contacting can be performed via a series of ethylene and methane economizers. In the preferred embodiment which is illustrated in FIG. 1 and which will be discuss in greater detail later, there is a main ethylene economizer, a main methane economizer and one or more additional methane economizers. These additional economizers are referred to herein as the second methane economizer, the third methane economizer and so forth and each additional methane economizer corresponds to a separate downstream flash step.

Inventive Method/Apparatus for Combining Open-Cycle and Process Steam

A key feature of the current invention is the manner in which in the compressed open cycle gas stream or recycle stream is precooled and combined with the main process stream which is to be liquefied in major portion and the unexpected improvements in process efficiencies associated with said method and associated apparatus. In the preferred embodiment, the compressed open cycle gas stream is an open methane cycle stream and the main process stream is a processed natural gas stream. As previously noted, process efficiency is routinely improved by subcooling the pressurized liquid products prior to a pressure reduction step by contacting via an indirect heat exchange means with downstream flash vapor. In a like manner, process efficiency can be improved by using the flash vapors to cool the stream prior to combining such recycle stream with the main process stream. Such cooling also allows the flash vapors to be returned to the compressor at near ambient temperatures. In the art, the recycle stream is cooled in its entirety and combined with the main process stream in the second cycle immediately upstream of the condenser where the combined stream is condensed in major portion.

We have discovered that unexpected improvements in process efficiencies are possible by selectively cooling the recycle stream in such a manner that two or more return streams of different temperatures are produced and subsequently combining these streams with the main process stream in the cascaded refrigeration process at locations where the respective stream temperatures are more similar. The partitioning of the recycle stream into two to four return streams is preferred and two to three return streams are more preferred. Most preferred is partitioning or splitting of the recycle stream into two return streams because of the increase in efficiency at minimal increase in capital cost and process complexity. For four return streams, each stream is preferably comprised of 10 to 70% of the recycle stream, more preferably 15 to 55%, and most preferably about 25%. For three return streams, each stream is preferably comprised of 10 to 80% of the recycle stream, more preferably 20 to 60%, and most preferably about 33%. For two return streams, each stream is preferably comprised of 20 to 80% of the recycle stream, more preferably 25 to 75%, and most preferably about 50%. When the closed refrigeration cycle immediately upstream of the open cycle consists of two or three stages, the most preferred configuration is two return streams with return locations upstream of the first stage chiller and upstream of the last stage condenser wherein the combined process stream is liquefied in major portion.

The inventive process for liquefying a pressurized gas stream is nominally comprised of first combining a pressurized gas stream with a first recycle gas stream which originates from a subsequent step to be described in greater detail. This stream is then cooled to near its liquefaction temperature via flow through at least one indirect heat exchange means and then combined with a second recycle gas stream to be described in greater detail. This combined stream is then further cooled by flow through at least one indirect heat means whereupon the stream is condensed in major portion. The pressure of this stream is then reduced by flow through at least one pressure reduction means thereby producing a two-phase stream. This stream is subsequently separated in a gas/liquid separator into a first return gas stream and a first product liquid stream. The return gas stream then flows through an indirect heat exchange means thereby producing a first warmed return gas stream which is then compressed to a pressure greater than or equal to the pressure possessed by the pressurized gas stream thereby producing a recycle gas stream. The recycle gas stream is then cooled to near ambient temperature and is then further cooled by flowing through at least one indirect heat exchange means in thermal contact with the earlier cited indirect heat exchange means through which the first return gas stream (i.e., flash vapors) flowed. The recycle gas stream is cooled in its entirety to a first temperature, the stream is then split into a first recycle gas stream and a second recycle stream, and the second stream further cooled by also flowing through at least one indirect heat exchange means in thermal contact with the earlier cited indirect heat exchange means through which the first return gas stream flowed thereby producing a second recycle gas stream possessing a temperature lower than that of the first gas recycle stream. The recycle gas streams and the return gas stream flow through their respective heat exchange means in a generally countercurrent manner to one another.

Ideally, the first recycle gas stream and second recycle stream should possess temperatures which are similar to the temperatures of the gas streams to which they are combined with so as to avoid thermodynamic irreversibilities associated with the mixing of fluids of different temperatures. From an operational and design perspective, this is generally more easily accomplished for the first recycle gas stream. Therefore, it is preferred that the first recycle stream and the process stream at the point of combination be at or about the same temperature and more preferably, the first recycle stream and the process stream at the point of combination be at or about the same temperature and the second recycle stream and the process stream at the point of combination be at or about the same temperature.

In a preferred embodiment, the pressurized gas stream is natural gas and preferably, the pressure of said stream is greater than 500 psia, more preferably greater than about 500 psia to 900 psia, still more preferably about 500 psia to about 675 psia, still yet more preferably about 600 psia to about 675 psia, and most preferably about 650 psia. As previously noted, the closed refrigeration cycle preferably employs a refrigerant comprised in a major portion of ethylene, ethane or a mixture thereof. Also as previously noted, it is preferred that an additional refrigeration cycle be employed whose primary function is to precool the pressurized gas stream. Preferably, the refrigerant employed in this closed cycle is comprised of propane in major portion and in a preferred embodiment, this cycle is also employed for cooling the compressed open cycle stream prior to cooling via indirect gas with the open-cycle flash gases. This refrigeration cycle also provides cooling duty to condense the compressed vapors in the cycle immediately upstream of the open cycle and therefore, the respective cycles are cascaded.

In a preferred embodiment, prior to flowing the condensed product through the above-cited pressure reduction means, the product is further cooled by flowing through at least one indirect heat exchange means which is in thermal contact with (i.e., can undergo heat exchange with) at least one indirect heat exchange means previously cited for warming the return gas stream and wherein said gas streams flow through their respective indirect heat exchange means in a generally countercurrent, preferably a countercurrent manner, manner to one another.

In a preferred embodiment, the process is also comprised of further pressure reduction steps wherein the first liquid stream from the gas-liquid separator located downstream of the first pressure reduction means is (1) cooled via flow through at least one indirect heat exchange means which is cooled via return gas streams originating from downstream flash or pressure reduction steps to be described; (2) flowing said cooled liquid stream through at least one pressure reduction means thereby producing a two-phase stream; and then (3) flowing said stream to a separator for gas/liquid separation from which is produced a second return gas stream and a second liquid stream. The second return gas stream then flows through an indirect heat exchange means in thermal contact with the just above-mentioned indirect heat exchange means employed for cooling the liquid stream and then flows through the at least one indirect heat exchange means in thermal contact in a generally countercurrent manner, preferably a countercurrent manner, with the previously described indirect heat exchange means employed for cooling the compressed recycle stream thereby producing a second warmed return. This stream is returned to the compressor, compressed, and then combined with the first warmed return stream for additional compression.

In a still more preferred embodiment, the second liquid stream is flowed through a pressure reduction means thereby producing a two-phase stream which is flowed to a gas/liquid separator from which is produced a third return gas stream and a third liquid stream. The third return gas stream then flows through an at least one indirect heat exchange means in thermal contact with the just above-mentioned indirect heat exchange means employed for cooling the second liquid stream and then flows through an at least one indirect heat exchange means in thermal contact in a generally countercurrent manner, preferably a countercurrent manner, with the previously described indirect heat exchange means employed for cooling the compressed recycle stream thereby producing a third warmed return. This stream is returned to the compressor, compressed, and then combined with the second warmed return stream for additional compression.

When liquefying natural gas at a process pressure of about 500 psia to about 675 psia, the preferred pressure following a single pressure reduction step is about 15 psia to about 30 psia. When employing the more preferred two-stage pressure reduction procedure, preferred pressures following pressure reduction are about 150 psia to about 250 psia for the first stage of reduction and about 15 psia to about 30 psia for the second stage. When employing the most preferred three-stage pressure reduction procedure, a pressure of the about 150 to about 250 psia is preferred for the first stage, about 45 to 80 psia for the second stage, and about 15 to about 30 psia for the third stage of pressure reduction. More preferred pressure ranges for the three-stage pressure reduction procedure are about 180 to 200 psia, about 50 to 70 psia, and about 20 to about 30 psia.

Preferred Open-Cycle Embodiment of Cascaded Liquefaction Process

The flow schematic and apparatus set forth in FIG. 1 is a preferred embodiment of the open-cycle cascaded liquefaction process and is set forth for illustrative purposes. Purposely omitted from the preferred embodiment is a nitrogen removal system, because such system is dependant on the nitrogen content of the feed gas. However as noted in the previous discussion of nitrogen removal technologies, methodologies applicable to this preferred embodiment are readily available to those skilled in the art. Those skilled in the art will also recognized that FIG. 1 is a schematic only and therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of the FIG. 1, items numbered 1 thru 99 are process vessels and equipment directly associated with the liquefaction process. Items numbered 100 thru 199 correspond to flow lines or conduits which contain methane in major portion. Items numbered 200 thru 299 correspond to flow lines or conduits which contain the refrigerant ethylene. Items numbered 300–399 correspond to flow lines or conduits which contain the refrigerant propane.

A feed gas, as previously described, is introduced to the system through conduit 100. Gaseous propane is compressed in multistage compressor 18 driven by a gas turbine driver which is not illustrated. The three stages preferably form a single unit although they may be separate units mechanically coupled together to be driven by a single driver. Upon compression, the compressed propane is passed through conduit 300 to cooler 20 where it is liquefied. A representative pressure and temperature of the liquefied propane refrigerant prior to flashing is about 100° F. and about 190 psia. Although not illustrated in FIG. 1, it is preferable that a separation vessel be located downstream of cooler 20 and upstream of expansion valve 12 for the removal of residual light components from the liquefied propane. Such vessels may be comprised of a single-stage gas liquid separator or may be more sophisticated and comprised of an accumulator section, a condenser section and an absorber section, the latter two of which may be continuously operated or periodically brought online for removing residual light components from the propane. The stream from this vessel or the stream from cooler 20, as the case may be, is pass through conduit 302 to a pressure reduction means such as a expansion valve 12 wherein the pressure of the liquefied propane is reduced thereby evaporating or flashing a portion thereof. The resulting two-phase product then flows through conduit 304 into high-stage propane chiller 2 wherein indirect heat exchange with gaseous methane refrigerant introduced via conduit 152, natural gas feed introduced via conduit 100 and gaseous ethylene refrigerant introduced via conduit 202 are respectively cooled via indirect heat exchange means 4, 6 and 8 thereby producing cooled gas streams respectively produced via conduits 154, 102 and 204.

The flashed propane gas from chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to chiller 22 through conduit 310 thereby providing a coolant for chiller 22.

The cooled feed gas stream from chiller 2 flows via conduit 102 to a knock-out vessel 10 wherein gas and liquid phases are separated. The liquid phase which is rich in C3+ components is removed via conduit 103. The gaseous phase is removed via conduit 104 and conveyed to propane chiller 22. Ethylene refrigerant is introduced to chiller 22 via conduit 204. In the chiller, the methanerich process stream and an ethylene refrigerant stream are respectively cooled via indirect heat exchange means 24 and 26 thereby producing cooled methane-rich process stream and an ethylene refrigerant stream via conduits 110 and 206. The thus evaporated portion of the propane refrigerant is separated and passed through conduit 311 to the intermediate-stage inlet of compressor 18. Liquid propane is passed through conduit 312, the pressure further reduced by passage through a pressure reduction means, illustrated as expansion valve 16, whereupon an additional portion of liquefied propane is flashed. The resulting two-phase stream is then fed to chiller 28 through conduit 314 thereby providing coolant to chiller 28.

As illustrated in FIG. 1, the methane-rich process stream flows from the intermediate-stage propane chiller 22 to the low-stage propane chiller/condenser 28 via conduit 110. In this chiller, the stream is cooled via indirect heat exchange means 30. In a like manner, the ethylene refrigerant stream flows from the intermediate-stage propane chiller 22 to the low-stage propane chiller/condenser 28 via conduit 206. In the latter, the ethylene-refrigerant is condensed via an indirect heat exchange means 32 in nearly its entirety. The vaporized propane is removed from the low-stage propane chiller/condenser 28 and returned to the low-stage inlet at the compressor 18 via conduit 320. Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively).

As illustrated in FIG. 1 and in accordance with the invention herein disclosed and claimed, a portion of a cooled compressed methane recycle stream is provided via conduit 156, combined with the methane-rich process stream exiting the low-stage propane chiller via conduit 112 and the combined methane-rich process stream is introduced to the high-stage ethylene chiller 42 via conduit 114. The novelty of this step will be discussed in greater detail in a subsequent section. Ethylene refrigerant exits the low-stage propane chiller 28 via conduit 208 and is fed to a separation vessel 37 wherein light components are removed via conduit 209 and condensed ethylene is removed via conduit 210. The separation vessel is analogous to the earlier discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature of about −24° F. and a pressure of about 285 psia. The ethylene refrigerant via conduit 210 then flows to the main ethylene economizer 34 wherein it is cooled via indirect heat exchange means 38 and removed via conduit 211 and passed to a pressure reduction means such as an expansion valve 40 whereupon the refrigerant is flashed to a preselected temperature and pressure and fed to the high-stage ethylene chiller 42 via conduit 212. Vapor is removed from this chiller via conduit 214 and routed to the main ethylene economizer 34 wherein the vapor functions as a coolant via indirect heat exchange means 46. The ethylene vapor is then removed from the ethylene economizer via conduit 216 and feed to the high-stage inlet on the ethylene compressor 48. The ethylene refrigerant which is not vaporized in the high-stage ethylene chiller 42 is removed via conduit 218 and returned to the ethylene main economizer 34 for further cooling via indirect heat exchange means 50, removed from the main ethylene economizer via conduit 220 and flashed in a pressure reduction means illustrated as expansion valve 52 whereupon the resulting two-phase product is introduced into the low-stage ethylene chiller 54 via conduit 222. The combined methane-rich process stream is removed from the high-stage ethylene chiller 42 via conduit 116 and directly fed to the low-stage ethylene chiller 54 wherein it undergoes additional cooling and partial condensation via indirect heat exchange means 56. The resulting two-phase stream then flows via conduit 118 to a two phase separator 60 from which is produced a methane-rich vapor stream via conduit 119 and via conduit 117, a liquid stream rich in $C_2$+ components which is subsequently flashed or fractionated in vessel 67 thereby producing via conduit 123 a heavies stream and a second methane-rich stream which is transferred via conduit 121 and alter combination with a second stream via conduit 128 is fed to the high pressure inlet port on the methane compressor 83.

The stream in conduit 119 and a cooled compressed methane recycle stream provided via conduit 158 are combined and fed via conduit 120 to the low-stage ethylene condenser 68 wherein this stream exchanger heat via indirect heat exchange means 70 with the liquid effluent from the low-stage ethylene chiller 54 which is routed to the low-stage ethylene condenser 68 via conduit 226. In condenser 68, the combined streams are condensed and produced from condenser 68 via conduit 122. The vapor from the low-stage ethylene chiller 54 via conduit 224 and low-stage ethylene condenser 68 via conduit 228 are combined and routed via conduit 230 to the main ethylene economizer 34 wherein the vapors function as a coolant via indirect heat exchange means 58. The stream is then routed via conduit 232 from the main ethylene economizer 34 to the low-stage side of the ethylene compressor 48. As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from the compressor is routed to a downstream cooler 72 via conduit 200. The product from the cooler flows via conduit 202 and is introduced, as previously discussed, to the high-stage propane chiller 2

The liquefied stream in conduit 122 is generally at a temperature of about −125° F. and about 600 psi. This stream passes via conduit 122 through the main methane economizer 74 wherein the stream is further cooled by indirect heat exchange means 76 as hereinafter explained. From the main methane economizer 74 the liquefied gas passes through conduit 124 and its pressure is reduced by a pressure reductions means which is illustrated as expansion valve 78, which of course evaporates or flashes a portion of the gas stream. The flashed stream is then passed to methane high-stage flash drum 80 where it is separated into a gas phase discharged through conduit 126 and a liquid phase discharged through conduit 130. The gas-phase is then transferred to the main methane economizer via conduit 126 wherein the vapor functions as a coolant via indirect heat exchange means 82. The vapor exits the main methane economizer via conduit 128 where it is combined with the gas stream delivered by conduit 121. These streams are then fed to the high pressure side of compressor 83. The liquid phase in conduit 130 is passed through a second methane economizer 87 wherein the liquid is further cooled by downstream flash vapor via indirect heat exchange means 88. The cooled liquid exits the second methane economizer 87 via conduit 132 and is expanded or flashed via pressure reduction means illustrated as expansion valve 91 to further reduce the pressure and at the same time, evaporate a second portion thereof. This flash stream is then passed to intermediate-stage methane flash drum 92 where the stream is separated into a gas phase passing through conduit 136 and a liquid phase passing through conduit 134. The gas phase flows through conduit 136 to the second methane economizer 87 wherein the vapor cools the liquid introduced to 87 via conduit 130 via indirect heat exchanger means 89. Conduit 138 serves as a flow conduit between indirect heat exchange means 89 in the second methane economizer 87 and the indirect heat exchange means 95 in the main methane economizer 74. This vapor leaves the main methane economizer 74 via conduit 140 which is connected to the intermediate stage inlet on the methane compressor 83. The liquid phase exiting the intermediate stage flash drum 92 via conduit 134 is further reduced in pressure, preferably to about 25 psia, by passage through a pressure reduction means illustrated as a expansion valve 93. Again, a third portion of the liquefied gas is evaporated or flashed. The fluids from the expansion valve 93 are passed to final or low stage flash drum 94. In flash drum 94, a vapor phase is separated and passed through conduit 144 to the second methane economizer 87 wherein the vapor functions as a coolant via indirect heat exchange means 90, exits the second methane economizer via conduit 146 which is connected to the first methane economizer 74 wherein the vapor functions as a coolant via indirect heat exchange means 96 and ultimately leaves the first methane economizer via conduit 148 which is connected to the low pressure port on compressor 83. The liquefied natural gas product from flash drum 94 which is at approximately atmospheric pressure is passed through conduit 142 to the storage unit. The low pressure, low temperature LNG boil-off vapor stream from the storage unit is preferably recovered by combining such stream with the low pressure flash vapors present in either conduits 144, 146, or 148; the selected conduit being based on a desire to match vapor stream temperatures as closely as possible.

As shown in FIG. 1, the high, intermediate and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas is discharged from high stage methane compressor through conduit 150, is cooled in cooler 86 and is routed to the high pressure propane chiller 2 via conduit 152 as previously discussed. The stream is cooled in chiller 2 via indirect heat exchange means 4 and flows to the main methane economizer via conduit 154. As used herein and previously noted, compressor refers to each stage of compression and any equipment associated with interstage cooling.

As previously noted, a key aspect of the current invention is the manner in which the stream delivered via conduit 154 is cooled in the main methane economizer 74 and the manner in which the cooled compressed streams are returned to the process for liquefaction. As illustrated in FIG. 1, the stream entering the main methane economizer 74 undergoes cooling in its entirety via flow through indirect heat exchange means 97. A portion of the cooled stream is removed via conduit 156 and returned to the natural gas stream undergoing processing upstream of the first stage (i.e., high pressure) of ethylene cooling. The remaining portion undergoes further cooling via indirect heat transfer mean 98 in the main methane economizer and is produced therefrom via conduit 158. This stream is combined with the natural gas stream undergoing processing at a location upstream of the final stage (i.e., low pressure) of ethylene cooling and the combined stream then undergoes liquefaction in major portion in the ethylene condenser 68 via flow through indirect heat exchange means 70.

As used herein, reference to separate indirect heat exchange means for the cooling or heating of a given stream may refer to a common indirect heat exchanger means. As an example, indirect heat exchange means A and B may refer to a single plate fine heat exchanger wherein the two streams fed to each means undergo heat exchange therein with one another.

FIG. 1 depicts the expansion of the liquefied phase using expansion valves with subsequent separation of gas and liquid portions in the chiller or condenser. While this simplified scheme is workable and utilized in some cases, it is often more efficient and effective to carry out partial evaporation and separation steps in separate equipment, for example, an expansion valve and separate flash drum might be employed prior to the flow of either the separated vapor or liquid to a propane chiller. In a like manner, certain process streams undergoing expansion are ideal candidates for employment of a hydraulic expander as part of the pressure reduction means thereby enabling the extraction of work and also lower two-phase temperatures.

With regard to the compressor/driver units employed in the process, FIG. 1 depicts individual compressor/driver units (i.e., a single compression train) for the propane, ethylene and open methane cycle compression stages. However in a preferred embodiment for any cascaded process, process reliability can be improved significantly by employing a multiple compression train comprising two or more compressor/driver combinations in parallel in lieu of the depicted single compressor/driver units. In the event that a compressor/driver unit becomes unavailable, the process can still be operated at a reduced capacity. In addition by shifting loads among the compressor/driver units in the manner herein disclosed, the LNG production rate can be further increased when a compressor/driver unit goes down or must operate at reduced capacity.

While specific cryogenic methods, materials, items of equipment and control instruments are referred to herein, it is to be understood that such specific recitals are not to be considered limiting but are included by way of illustration and to set forth the best mode in accordance with the presence invention.

EXAMPLE I

This Example demonstrates the ability of the inventive process and associated apparatus to improve the overall efficiency of a cascaded refrigeration process for liquefying natural gas wherein propane and ethylene are employed as the refrigerants in the first and second closed cycles and predominantly methane is employed in the third cycle which is operated in an open configuration. This Example shows that a significant improvement in process efficiency is possible by shifting the respective loadings and therefore cooling duties among the stages in the second cycle in the manner set forth. The simulation results were obtained using Hyprotech's Process Simulation HYSIM, version 386/C2.10, Prop. Pkg PR/LK.

The simulation package was generally configured as set forth in FIG. 1. Deviations between the process as illustrated in FIG. 1 and that simulated for this Example do not significantly affect the inventive aspects of the process and associated apparatus herein demonstrated. Each simulation employed a feed gas to the first stage of propane cooling as set forth in TABLE 1 and required that the LNG production rate to storage for each simulation be the same. Notable deviations from the FIG. 1 illustration include the presence of three stages rather than two stages of cooling in the second (i.e., ethylene) cycle wherein product from the second stage of ethylene cooling was fed directly to the third stage of cooling as a two-phase stream and modification of the LNG flash step to provide for the recovery of a pressurized fuel gas. As discussed in the Specification, the inclusion of this step also provides a means for the removal of nitrogen from the LNG product. Other deviations from FIG. 1 include the presence of gas/liquid separators downstream of certain of the propane cooling stages and the first stage of ethylene cooling.

As previously noted, the simulation did not employ a single flash and separation to reduce the high pressure LNG produced from the main economizer to a colder intermediate pressure LNG stream and a flash vapor which is recycled. Rather, the stream as simulated flowed through a fuel gas economizer wherein the stream was cooled via contact with the flashed fuel gas stream and a second stream. Upon exiting the economizer, the stream was flashed from about 620 psia to 420 psia, flowed to a fuel gas separator from which was produced the fuel gas stream and a liquid stream and the fuel gas stream was subsequently flowed through the fuel gas economizer countercurrent to the flow of high pressure LNG stream and subsequently to the main methane economizer wherein the stream provided additional cooling prior to being employed as a fuel gas. The liquid stream from the fuel gas separator was subsequently flashed to the intermediate flash pressure, in this case 185 psia, flowed to a separator from which was produced an intermediate pressure gas stream and a liquid stream. The liquid stream became the second liquid stream fed to the fuel gas economizer where it provided additionally cooling and was subsequently converted to a two-phase stream which was fed to a gas/liquid separator. A second intermediate pressure gas stream was produced from this separator which was subsequently combined with the intermediate pressure gas stream previously described and was returned to the main methane economizer as illustrated in FIG. 1. This stream ultimately was fed to the high pressure inlet port at the methane compressor. The liquid stream from the above separator subsequently flowed through the economizer illustrated in FIG. 1 immediately downstream of the separator which followed the flash step wherein the pressure of the LNG stream was reduced from a high to intermediate pressure (ex., 620 psia to 180 psia). The remaining flash steps were conducted in the manner and at conditions representative of those set forth in the Specification.

Two process simulations were conducted which will be referred to herein as the Base Case and the Inventive Case. The Base Case simulation provided for the return of the recycle or the open methane cycle stream produced from the main methane economizer to a location immediately upstream of the low stage ethylene condenser wherein the majority of the process stream was condensed. At this upstream location, this recycle stream was combined with the processed natural gas stream.

In the simulation results for the Inventive Case which employed the invention herein claimed, a portion of the open methane cycle stream did not undergo maximum cooling in the main methane economizer. Rather, the total stream was cooled to the temperature of the process stream immediately upstream of the high stage ethylene chiller, the stream was split, and a portion of the cooled stream routed to this upstream location and the remaining portion further cooled in the main methane economizer and combined with the process stream previously described at the location immediately upstream of the low stage ethylene condenser. The open methane cycle stream was split such that on a mass basis 53.8% of the stream was recombined with the process stream immediately upstream of the low stage ethylene condenser. The Inventive Case and Base Case simulations also differed in that the pressure of the recycle or open methane cycle stream in the Inventive Case, was increased to match the pressure at the upstream injection point or in this case, a pressure of about 633 psia. This increase in pressure of approximately 13 psia was accomplished by increasing the compression ration and thus, the power requirements of the final stage of methane compression over that required in the Base Case.

Figure 2:
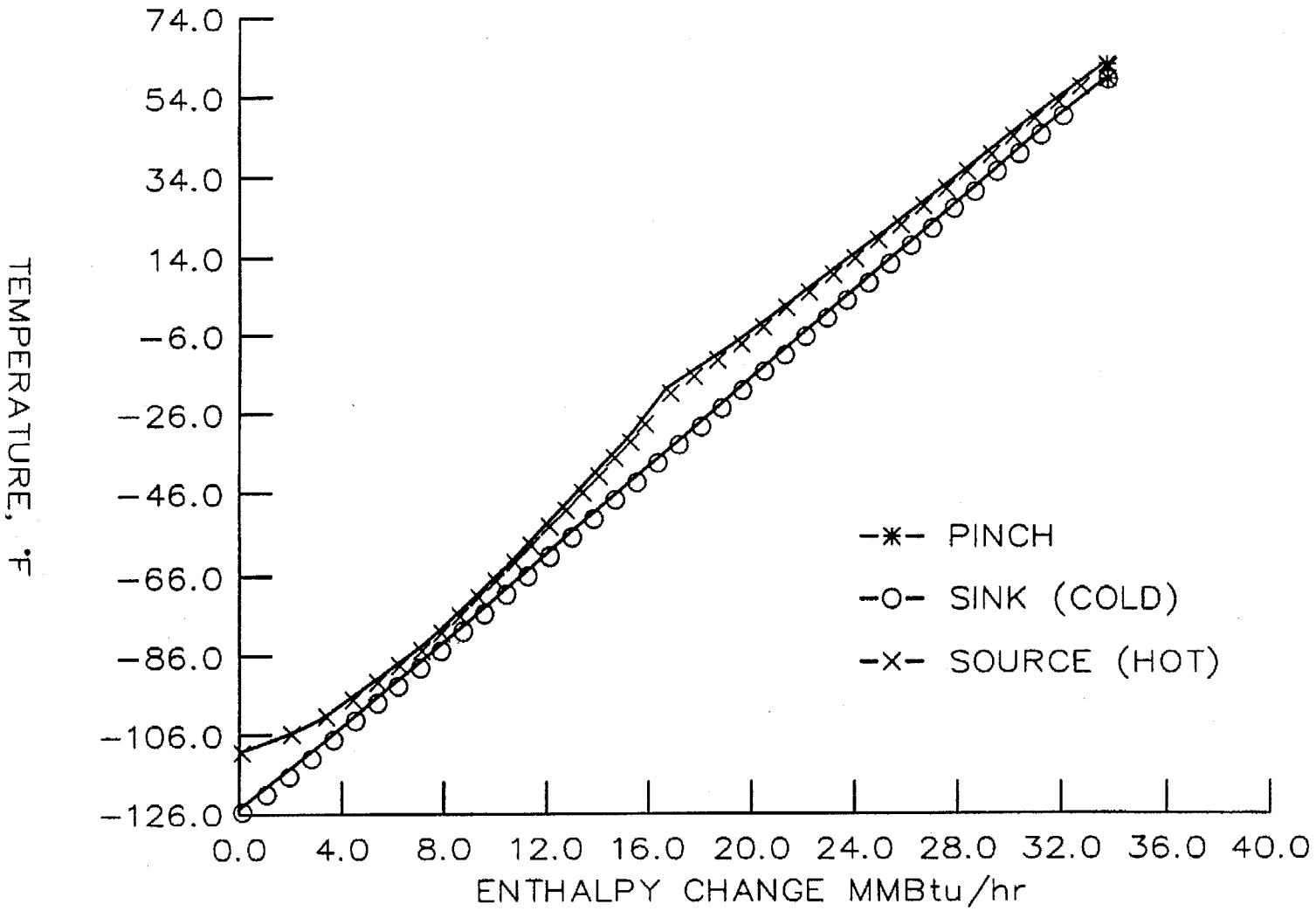
FIG. 2 is a cooling curve which illustrates the narrow approach of heating and cooling fluid temperatures in the main methane economizer made possible by the current invention.
Figure 3:
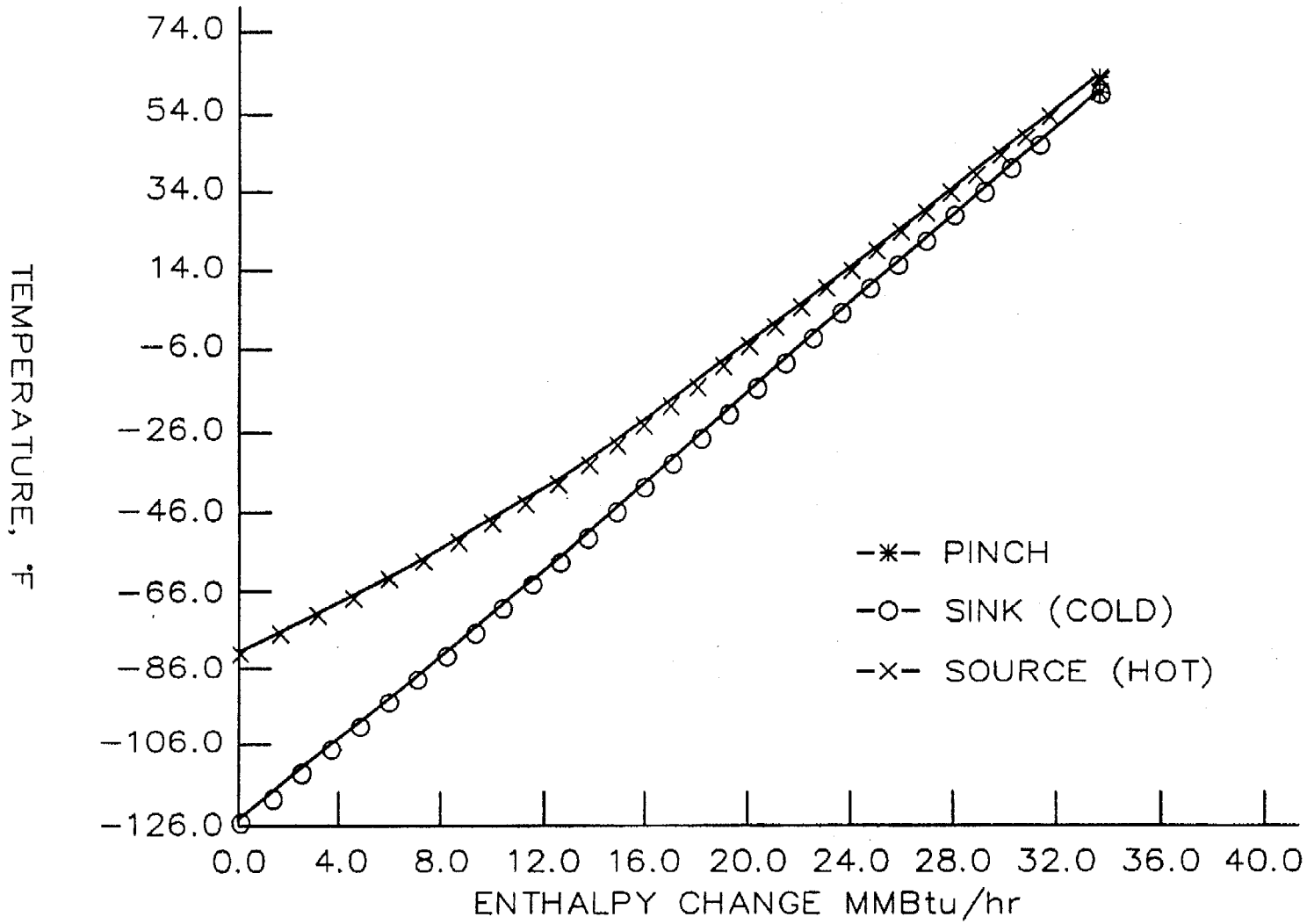
FIG. 3 is a cooling curve which illustrates the approach of the heating and cooling fluid temperatures in the main methane economizer using the open-cycle methodology taught by the prior art.

Present in Table 2 are the compression requirements for the Inventive Case and the Base Case. Again, both cases simulated the production of equivalent amounts of LNG and were based on the same feed gas composition. The results show that the inventive scheme reduces total horsepower requirement by 1.44% compared to the Base Case and furthermore, refrigeration duty has been shifted from the low stage to the intermediate and higher stages in the ethylene cycle. Presented in FIGS. 2 and 3 are the respective cooling curves for the compressed recycle stream upon flowing through the main methane economizer. The curves clearly illustrate that the stream from the main methane economizer for the Inventive Case is at a much colder temperature than for the Base Case which in turn reduces the cooling duty on the main condenser. Additionally, the closer proximity of the heat source and cooling sink curves to one another for the Inventive Case than for the Base Case clearly demonstrates that irreversibilities associated with heat transfer are significantly reduced by the methodology and apparatus on which the Inventive Case was based.

TABLE 1

FEED GAS COMPOSITION

| Component | Mole Percent |
|---|---|
| Nitrogen | 0.12 |
| Methane | 92.31 |
| Ethane | 4.23 |
| Propane | 1.83 |
| i-Butane | 0.31 |
| n-Butane | 0.61 |
| i-Pentane | 0.19 |
| n-Pentane | 0.19 |
| n-Hexane | 0.21 |
| | 100.00 |

TABLE 2

INVENTIVE CASE AND BASE CASE COMPRESSION REQUIREMENTS

| | HEAD (FT) | | BRAKE HORSEPOWER | |
|---|---|---|---|---|
| COMPRESSOR | INVENTIVE CASE | BASE CASE | INVENTIVE CASE | BASE CASE |
| PROPANE | | | | |
| Low Stage | 12053 | 12053 | 0.0718 | 0.0717 |
| Intermediate Stage | 14320 | 14320 | 0.1270 | 0.1269 |
| High Stage | 12051 | 12072 | 0.1583 | 0.1584 |
| ETHYLENE | | | | |
| Low Stage | 17251 | 17235 | 0.0471 | 0.0551 |

TABLE 2-continued

INVENTIVE CASE AND BASE CASE COMPRESSION REQUIREMENTS

| COMPRESSOR | HEAD (FT) INVENTIVE CASE | HEAD (FT) BASE CASE | BRAKE HORSEPOWER INVENTIVE CASE | BRAKE HORSEPOWER BASE CASE |
|---|---|---|---|---|
| Intermediate Stage | 26459 | 26668 | 0.1065 | 0.1137 |
| High Stage | 28724 | 29075 | 0.1581 | 0.1597 |
| METHANE | | | | |
| Low Stage | 77082 | 77082 | 0.0400 | 0.0400 |
| Intermediate Stage | 78308 | 78307 | 0.0874 | 0.0874 |
| High Stage | 73350 | 72507 | 0.1894 | 0.1872 |
| | | | 0.9856 | 1.0000 |

[1]Normalized to Total Horsepower Requirement for Base Case

That which is claimed:

1. A process for liquefying a pressurized gas stream comprising the steps of:

(a) combining the pressurized gas stream and a first recycle gas stream as defined in step (j);

(b) cooling said stream of step (a) to near its liquefaction temperature;

(c) combining said stream of step (b) and a second recycle gas stream as defined in step (j);

(d) cooling and thereby condensing in major portion said stream of step (c);

(e) flowing said stream of step (d) through at least one pressure reduction means thereby producing a two-phase stream;

(f) separating the two-phase stream of step (e) into a return gas stream and a liquid stream;

(g) flowing said return gas stream of step (f) through an indirect heat exchange means thereby producing a warmed return gas stream;

(h) compressing said warmed return gas stream to a pressure greater than or equal to the pressure possessed by the pressurized gas stream of step (a) thereby producing a compressed return gas stream;

(i) cooling the compressed return gas stream of step (h) to a near ambient temperature, and (j) cooling further the compressed return gas stream of step (i) by flowing through an indirect heat exchange means which is in thermal contact with the indirect heat exchange means of step (g) wherein said cooling comprises cooling said compressed return gas stream in its entirety to a first temperature, splitting said stream into a first recycle gas stream and a second compressed return gas stream, and further cooling said second stream thereby producing a second recycle gas stream possessing a temperature lower than that of the first recycle gas stream and wherein the gas streams of step (g) and this step flow through their respective indirect heat exchange means in a generally countercurrent manner to one another.

2. A process according to claim 1 wherein said pressurized gas stream is a pressurized natural gas stream.

3. A process according to claim 2 wherein said pressurized gas stream is at a pressure of at least 500 psia.

4. A process according to claim 1 wherein cooling for step (b) and step (d) is provided via a closed refrigeration cycle employing ethylene, ethane or a mixture thereof as a refrigerant.

5. A process according to claim 4 wherein the closed refrigeration cycle provides at least a portion of the cooling for step (i).

6. A process according to claim 4 further comprising the step of precooling the pressurized gas stream prior to step (a) wherein such precooling is provided via a closed refrigeration system employing a refrigerant comprised in a major portion of propane and said refrigeration system also provides cooling to the closed refrigeration cycle of claim 4.

7. A process according to claim 6 further comprising the additional steps of:

(k) cooling said liquid stream of step (f) by flowing through an indirect heat exchange means;

(l) flowing said liquid stream of step (k) through at least one pressure reduction means thereby producing a two-phase stream;

(m) separating the two-phase stream of step (l) into a return gas stream and a liquid stream;

(n) flowing said return gas stream of step (m) through an indirect heat exchange means in thermal contact with said indirect heat exchange means of step (k) wherein the streams flowing through the respective indirect heat exchange in a generally countercurrent manner to one another;

(o) flowing said return gas stream of step (n) through an indirect heat exchange means in thermal contact with said indirect heat exchange means of step (j) thereby producing a warmed return gas stream and wherein the streams flowing through the respective indirect heat exchange means in a generally countercurrent manner to one another;

(p) compressing said warmed return gas stream of step (o) to a pressure about equal to that of the warmed return gas of step (g);

(q) combining said gas stream of step (p) and gas stream of step (g) and feeding said combined stream to step (h) for compression.

8. A process according to claim 7 comprising the additional step of flowing the product of step (d) through an indirect heat exchange means which is in thermal contact with the indirect heat exchange means of steps (g) and (o) and wherein the flow through the indirect heat exchange means of this step in a generally countercurrent manner to the flow through the indirect heat exchange means of steps (g) and (o).

9. A process according to claim 7 comprising the additional steps of (r) flowing said liquid stream of step (m) through at least one pressure reduction means thereby producing a two-phase stream;

(s) separating the two-phase stream of step (r) into a return gas stream and a liquid stream;

(t) flowing said return gas stream of step (s) through an indirect heat exchange means in thermal contact with said indirect heat exchange means of step (k) wherein the streams flowing through the respective indirect heat exchange means flow in a generally countercurrent manner to one another;

(u) flowing said return gas stream of step (t) through an indirect heat exchange means in thermal contact with said indirect heat exchange means of step (j) thereby producing a warmed return gas stream and wherein the streams flowing through the respective indirect heat exchange means flow in a generally countercurrent manner to one another;

(v) compressing said warmed return gas stream of step (u) to a pressure about equal to that of the warmed return gas of step (o);

(w) combining said gas stream of step (v) and gas stream of step (o) and feeding said combined stream to step (p) for compression.

10. A process according to claim 9 comprising the additional step of flowing the product of step (d) through an indirect heat exchange means which is in thermal contact with the indirect heat exchange means of steps (g), (o) and (u) and wherein said stream flows generally countercurrent to the flow of fluids in the heat exchange means of steps (g), (o), and (u).

11. A process according to claim 10 wherein the pressurized gas stream is a pressurized natural gas and the pressure of said gas stream is about 500 psia to about 675 psia, the pressure following the pressure reduction means of step (e) is about 150 psia to about 250 psia, the pressure following the pressure reduction means of step (l) is about 45 psia to about 80 psia, and the pressure following the pressure reduction means of step (r) is about 15 psia to about 30 psia.

12. A process according to claim 11 wherein the temperatures of the pressurized gas stream of step (a) and the first recycle stream of step (j) are about equal.

13. A process according to claim 12 wherein the closed refrigeration cycle of claim 4 employs two stages.

14. A process according to claim 1 comprising the additional step of flowing the product of step (d) through an indirect heat exchange means which is in thermal contact with the indirect heat exchange means of step (g) and wherein said gas streams flow through their respective indirect heat exchange means in a generally countercurrent manner to one another.

15. A process for liquefying a pressurized natural gas stream possessing a pressure of greater than 500 psia and near ambient temperature comprising the steps of:

(a) cooling said gas stream to a first temperature significantly about the liquefaction temperature of said stream via a closed refrigeration cycle which employs a refrigerant comprised in a major portion of propane;

(b) combining the pressurized gas stream and a first recycle gas stream as defined in step (k);

(c) cooling said stream of step (a) to near its liquefaction temperature via a closed refrigeration cycle which employs a refrigerant comprised in major portion of ethylene, ethane or mixtures thereof;

(d) combining said stream of step (c) and a second recycle gas stream as defined in step (k);

(e) cooling and thereby condensing in major portion said stream of step (c) via the refrigeration system of step (d);

(f) flowing said stream of step (e) through at least one pressure reduction means thereby producing a two-phase stream;

(g) separating the two-phase stream of step (f) into a return gas stream and a second stream;

(h) flowing said return gas stream of step (g) through an indirect heat exchange means thereby producing a warmed return gas stream;

(i) compressing said warmed return gas stream to a pressure greater than or equal to the pressure possessed by the pressurized gas stream of step (b) thereby producing a compressed return gas stream;

(j ) cooling the compressed return gas stream of step (i) to a near ambient temperature via the closed refrigeration cycle of step (a);

(k) cooling further the compressed return gas stream of step (j) by flowing through an indirect heat exchange means which is in thermal contact with the indirect heat exchange means of step (h) wherein said cooling comprises cooling the compressed return gas stream in its entirety to a first temperature which is about equal to the temperature of the pressurized gas stream from step (a), splitting said stream into a first recycle gas stream and a second compressed return gas stream, and further cooling said second stream thereby producing a second recycle gas stream possessing a temperature lower than that of the first gas recycle stream and wherein the gas streams of step (g) and this step flows through their respective indirect heat exchange means in a manner countercurrent to one another.

16. A process according to claim 15 comprising the additional steps of:

(l) cooling said liquid stream of step (g) by flowing through an indirect heat exchange means;

(m) flowing said liquid stream of step (l) through at least one pressure reduction means thereby producing a two-phase stream;

(n) separating the two-phase stream of step (m) into a return gas stream and a liquid stream;

(o) flowing said return gas stream of step (n) through an indirect heat exchange means in thermal contact with said indirect heat exchange means of step (l) wherein the streams flowing through the respective indirect heat exchange means flow countercurrent to one another;

(p) flowing said return gas stream of step (o) through an indirect heat exchange means in thermal contact with said indirect heat exchange means of step (k) thereby producing a warmed return gas stream and wherein the streams flowing through the respective indirect heat exchange means flow countercurrent to one another;

(q) compressing said warmed return gas stream of step (p) to a pressure about equal to that of the warmed return gas of step (h);

(r) combining said gas stream of step (q) and gas stream of step (h) and feeding said combined stream to step (i) for compression.

17. A process according to claim 16 comprising the additional steps of:

(s) flowing said liquid stream of step (n) through at least one pressure reduction means thereby producing a two-phase stream;

(t) separating the two-phase stream of step (s) into a return gas stream and a liquid stream;

(u) flowing said return gas stream of step (t) through an indirect heat exchange means in thermal contact with said indirect heat exchange means of step (l) wherein the streams flowing through the respective indirect heat exchange means flow countercurrent to one another;

(v) flowing said return gas stream of step (u) through an indirect heat exchange means in thermal contact with said indirect heat exchange means of step (k) thereby producing a warmed return gas stream and wherein the streams flowing through the respective indirect heat exchange means flow countercurrent to one another;

(w) compressing said warmed return gas stream of step (v) to a pressure about equal to that of the warmed return gas of step (p);

(x) combining said gas stream of step (w) and gas stream of step (p) and feeding said combined stream to step (q) for compression wherein the pressure of pressurized natural gas stream is about 500 psia to about 675 psia, the pressure following the pressure reduction means of step (f) is about 150 psia to about 250 psia, the pressure following the pressure reduction means of step (m) is about 45 psia to about 80 psia, and the pressure following the pressure reduction means of step (s) is about 15 psia to about 30 psia.

18. A process according to claim 16 comprising the additional step of flowing the product of step (e) through an indirect heat exchange means which is in thermal contact with the indirect heat exchange means of steps (h), (p) and (v) and wherein said stream flows countercurrent to the flow of fluids in the heat exchange means of steps (h), (p), and (v).

19. In a process for liquefying a pressurized gas stream via an open-cycle, cascaded refrigeration process comprising a closed propane cycle with two or three stages of cooling, a closed ethylene, ethane or mixture thereof cycle with two or three stages of cooling, and an open methane cycle with at least two stages of pressure reduction and wherein the flash vapors from the pressure reduction stages are employed to cool the open methane cycle stream following pressurization and cooling to near ambient temperature, the improvement comprises (a) cooling the open methane cycle stream via countercurrent heat transfer with one or more flash vapor streams to a first temperature;

(b) splitting said cooled open methane cycle stream into a first cooled recycle stream and a second stream;

(c) combining the first cooled recycle stream with the pressurized gas stream immediately upstream of the first stage of cooling in an ethane, ethylene or mixture thereof cycle;

(d) further cooling the second stream via countercurrent heat transfer with one or more flash vapor streams to a second temperature thereby producing a second cooled recycle stream;

(e) combining said second cooled recycle stream with the pressurized gas stream undergoing processing downstream of the first stage of cooling in the ethylene or ethane cycle but upstream of the stage wherein the stream is liquefied in major portion.

20. A process according to claim 19 wherein the pressurized gas stream is pressured natural gas at a pressure greater than 500 psia.

21. A process according to claim 20 wherein the ethylene, ethane or mixture thereof cycle employs two or three stages and the open methane cycle employs two or three stages of pressure reduction.

22. A process according to claim 21 wherein the open methane cycle employs three stages of pressure reduction, the pressure of pressurized natural gas stream is about 500 psia to about 675 psia and the respective pressures in the open methane cycle following pressure reduction means are about 150 psia to about 250 psia, about 45 psia to about 80 psia, and about 15 psia to about 30 psia.

23. A process according to claim 22 wherein the temperature of the first cooled recycle stream and the pressurized gas stream to step (c) are about equal.

24. An apparatus for liquefying a pressurized gas comprising:

(a) a conduit for a first recycle stream;

(b) a conduit for a pressurized gas stream;

(c) a conduit connected to said conduits of(a) and (b);

(d) a chiller connected at the inlet end to conduit (c);

(e) a conduit connected to the outlet end of the chiller of (d);

(f) a conduit for a second recycle stream;

(g) a conduit connected to said conduits of (e) and (f);

(h) a condenser connected at the inlet end to said conduit of (g);

(i) a conduit connected to said condenser of (h);

(j) a pressure reduction means connected to said conduit of (i);

(k) a conduit connected to said pressure reduction means;

(l) a separator connected to the conduit of (k);

(m) a conduit connected to the upper section of the separator for removal of a gas stream;

(n) a conduit connected to the lower section of the separator for the removal of a liquid stream;

(o) an indirect heat exchange means connected to said conduit of (m);

(p) a conduit connected to said indirect heat exchange means;

(q) a compressor which is connected at an inlet port location to said conduit of (p);

(r) a conduit connected at an outlet port of said compressor;

(s) an indirect heat exchange means connected to said conduit of (r) and situated in close proximity to the indirect heat exchange means of element (o) so as to provide for heat exchange between the two means, situated such that fluids flowing through such means flow generally countercurrent to one another, and to which is connected at some point along such means between the entrance and exit is the conduit of (a) and to which is connected at the exit end is the conduit of (f).

25. An apparatus according to claim 24 further comprising a (t) an indirect heat exchange means connected at the entrance end to said conduit of step (n);

(u) a conduit connected to said indirect heat exchange means of (t) at the exit end;

(v) a pressure reduction means connected to said conduit of (u);

(w) a conduit connected to said pressure reduction means of (v);

(x) a separator connected to the conduit of (w);

(y) a conduit connected to the upper section of the separator for removal of a gas stream;

(z) a conduit connected to the lower section of the separator for the removal of a liquid stream;

(aa) an indirect heat exchange means connected to said conduit of (y) situated in a close proximity to the indirect heat exchange means of element (t) so as to provide for heat exchange between the two means and situated such that fluids flowing through such means flow generally countercurrent to one another; and (bb) a conduit connected to the exit end of the indirect heat transfer means of (aa);

(cc) an indirect heat transfer means connected to said conduit of (bb) situated in a close proximity to the indirect heat transfer means of element (s) so as to provide for heat exchange between the two means and situated such that fluids flowing through such means flow generally countercurrent to one another;

(dd) a conduit connected to said indirect heat exchange means of (cc) and which is connected to an inlet port on the compressor of element (q).

26. An apparatus according to claim 25 further comprising a (ee) a pressure reduction means connected to said conduit of (z);

(ff) a conduit connected to said pressure reduction means of (ee);

(gg) a separator connected to the conduit of (ff);

(hh) a conduit connected to the upper section of the separator for removal of a gas stream;

(ii) a conduit connected to the lower section of the separator for the removal of a liquid stream;

(jj) an indirect heat exchange means connected to said conduit of (hh) situated in close proximity to the indirect heat exchange means of element (t) so as to provide for heat exchange between the two means and situated such that fluids flowing through such means flow generally countercurrent to one another.

(kk) a conduit connected to the exit end of the indirect heat transfer means of (jj);

(ll) an indirect heat transfer means connected to said conduit of (kk) situated in close proximity to the indirect heat transfer means of element (s) so as to provide for heat exchange between the two means and situated such that fluids flowing through such means flow generally countercurrent to one another;

(mm) a conduit connected to said indirect heat exchange means of (jj) and which is connected to an inlet port on the compressor of element (q).

27. An apparatus according to claim 26 additionally comprising (nn) an indirect heat exchange means situated in the conduit of element (i) wherein said means is situated in close proximity to the indirect heat exchange means of elements (o), (cc) and (ll) so as to provide for heat exchange between the two means and situated such that fluids flowing through such means flow generally countercurrent to one another.

28. An apparatus according to claim 24 additionally comprising (jj) an indirect heat exchange means situated in the conduit of element (i) wherein said means is situated in close proximity to the indirect heat exchange means of element (o) so as to provide for heat exchange between the two means and situated such that fluids flowing through such means flow generally countercurrent to one another.

29. An apparatus according to claim 25 additionally comprising (nn) an indirect heat exchange means situated in the conduit of element (i) wherein said means is situated in close proximity to the indirect heat exchange means of elements (o) and (dd) so as to provide for heat exchange between the two means and situated such that fluids flowing through such means flow generally countercurrent to one another.

* * * * *

UNITED STATES PATENT AND TRADEMARK OFFICE
CERTIFICATE OF CORRECTION

PATENT NO. : 5,669,234

DATED : September 23, 1997

INVENTOR(S) : Clarence G. Houser, Jame Yao, Donald L. Andress, William R. Low

It is certified that error appears in the above-identified patent and that said Letters Patent is hereby corrected as shown below:

Column 27, line 28, "(jj)" should be --- (ll) ---.

Signed and Sealed this

Tenth Day of March, 1998

*Attest:*

*Attesting Officer*

BRUCE LEHMAN

*Commissioner of Patents and Trademarks*